US011100768B2

(12) United States Patent
Menschik et al.

(10) Patent No.: US 11,100,768 B2
(45) Date of Patent: Aug. 24, 2021

(54) COLLISION RISK MITIGATION PEDESTRIAN LIGHT EMITTER

(71) Applicants: Aden Menschik, Rockville, MD (US); David Menschik, Rockville, MD (US)

(72) Inventors: Aden Menschik, Rockville, MD (US); David Menschik, Rockville, MD (US)

( * ) Notice: Subject to any disclaimer, the term of this patent is extended or adjusted under 35 U.S.C. 154(b) by 334 days.

(21) Appl. No.: 16/403,159

(22) Filed: May 3, 2019

(65) Prior Publication Data

US 2020/0349816 A1 Nov. 5, 2020

(51) Int. Cl.

| | |
|---|---|
| ***G08B 5/36*** | (2006.01) |
| ***F21V 21/22*** | (2006.01) |
| ***F21V 21/26*** | (2006.01) |
| ***F21V 21/08*** | (2006.01) |
| ***F21V 21/32*** | (2006.01) |
| *F21Y 115/10* | (2016.01) |

(52) U.S. Cl.

CPC ..... *G08B 5/36* (2013.01); *F21V 21/08* (2013.01); *F21V 21/22* (2013.01); *F21V 21/26* (2013.01); *F21V 21/32* (2013.01); *F21Y 2115/10* (2016.08)

(58) Field of Classification Search

CPC .. G08B 5/36; G08B 5/38; G08B 5/006; F21L 4/00; F21L 4/04; F21V 21/08; F21V 21/0816; F21V 21/0832; F21V 21/22; F21V 21/26; F21V 21/32; F21W 2111/10

See application file for complete search history.

(56) References Cited

U.S. PATENT DOCUMENTS

| | | | | |
|---|---|---|---|---|
| 2,833,502 A * | 5/1958 | Wildeboor | ..... | F21V 21/08 248/231.41 |
| 2004/0140911 A1* | 7/2004 | Chen | ..... | E01F 9/617 340/908 |
| 2008/0049416 A1* | 2/2008 | Fisherman | ..... | B42D 3/123 362/98 |
| 2015/0330558 A1* | 11/2015 | Intravatola | ..... | F16M 11/28 362/184 |

* cited by examiner

*Primary Examiner* — Alan B Cariaso

(57) ABSTRACT

A collision risk mitigation pedestrian light emitter is a safety device through which a pedestrian's presence is visually signaled to a vehicle operator to decrease collision potential. The safety device includes a first telescoping leg, a second telescoping leg, a light-emitting device, a power source, and a locking mechanism. The first telescoping leg and second telescoping leg are terminally and hingedly connected to each other to form an L-shaped structure. The locking mechanism secures the L-shaped structure and is mechanically integrated between the first telescoping leg and second telescoping leg. The light-emitting device visually indicates the pedestrian's presence and is adjacently mounted to the first telescoping leg to enable variable light height adjustment. The light-emitting device is powered by and electrically connected to the power source mounted to the first telescoping leg. The second telescoping leg is used to mount/attach the safety device to the pedestrian, preferably to a backpack.

15 Claims, 5 Drawing Sheets

COLLISION RISK MITIGATION PEDESTRIAN LIGHT EMITTER

FIELD OF THE INVENTION

The present invention relates generally to pedestrian safety devices. More specifically, the present invention is a collision risk mitigation device for a pedestrian that provides additional visual indication of the presence of a pedestrian to vehicle operators. Thus, the present invention mitigates the risk of vehicle collisions with pedestrians.

BACKGROUND OF THE INVENTION

The field of vehicle to pedestrian collision risk mitigation is essential for reducing associated morbidity and mortality. There are a number of inventions in the field pertaining to vehicle-related modifications that account for the height of objects with which a vehicle may collide and that can assist a driver in avoiding a collision with a pedestrian. A driver's line of sight with a potential collision object can be a critical determinant of whether a collision with such an object occurs. Since a pedestrian's highest visible point can be below a driver's line of sight, a pedestrian device that increases the pedestrian's effective visible height can enable a driver to see and avoid colliding with a pedestrian with whom that driver might otherwise collide. Further, a disproportionate number of collisions occur outside of daylight hours and even individuals who may be sufficiently tall to be in a driver's line of sight during daylight hours can be at increased risk of vehicle collisions due to poor visibility in the dark.

The present invention is a safety device that decreases the potential for collisions by increasing the visibility of a pedestrian's presence via a light source mounted to the pedestrian at an elevated height that is more likely to be in the line of sight of a vehicle driver. The present invention acts as a visual alert to a vehicle operator throughout the day and particularly when natural lighting conditions are sub-optimal (e.g., in the dark). The present invention is lightweight, waterproof, portable, and durable. In general, the present invention is a light source mounted to a telescoping extension pole that is connected at its opposite end to an extension rod used for mounting the device. The extension rod is designed to fit inside a backpack (preferred mounting method) and to be held firmly through tension, while the telescoping extension pole extends through the backpack opening (with potential additional support from the backpack zipper) to position the light source above the backpack and above the head of the user. The present invention is further designed to be collapsible for transport and storage purposes.

DETAIL DESCRIPTIONS OF THE INVENTION

All illustrations of the drawings are for the purpose of describing selected versions of the present invention and are not intended to limit the scope of the present invention.

The present invention is a collision risk mitigation device for a pedestrian that provides visual indication to vehicle operators that a pedestrian is present. Thus, the present invention mitigates the risk of vehicle collisions with pedestrians. In general, the present invention is a visually alerting device for a user that mounts a lighting device at elevated height relative to the user to increase the user's visibility to vehicle operators.

Figure 1:
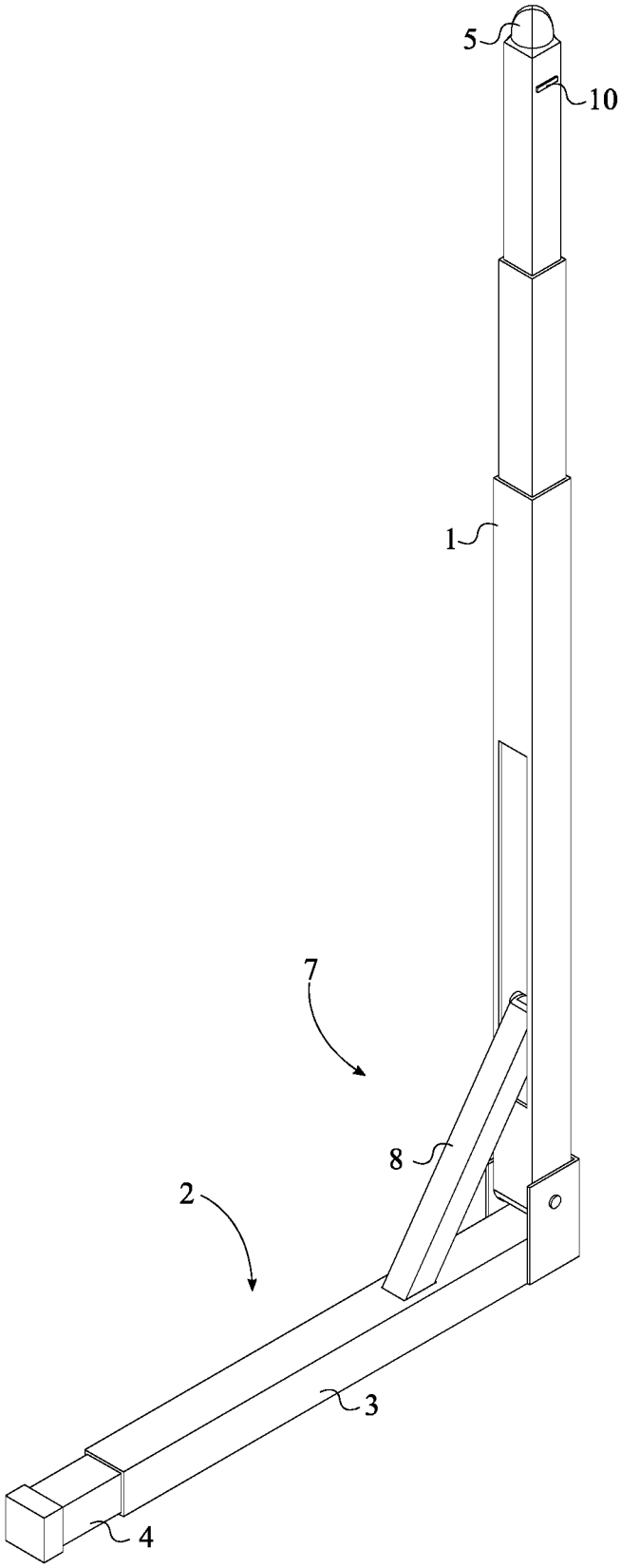
FIG. 1 is a perspective view of the present invention in a functional configuration.
Figure 5:
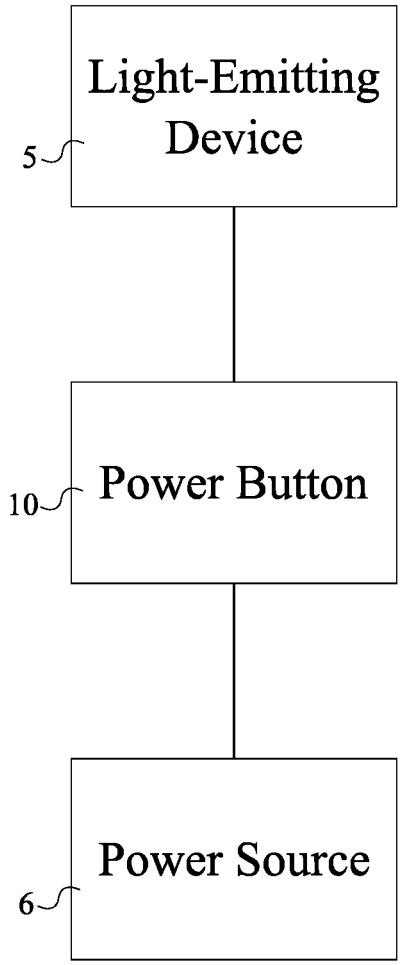
FIG. 5 is an electronic schematic diagram of the present invention.

Referring to FIG. 1 and FIG. 5, the present invention comprises a first telescoping leg 1, a second telescoping leg 2, a light-emitting device 5, a power source 6, and a power button 10. The first telescoping leg 1 and the second telescoping leg 2 make up the structural frame of the present invention. The first telescoping leg 1 and the second telescoping leg 2 are each an elongated tubular structure with multiple segments that are slidably engaged with each other to allow for variable length adjustment. Additionally, in between each of the multiple segments of the first telescoping leg 1 and the second telescoping leg 2 is a locking mechanism that secures and locks the first telescoping leg 1 and the second telescoping leg 2 into specific lengths. The second telescoping leg 2 mounts/attaches the present invention to the user while the first telescoping leg 1 supports and elevates the light-emitting device 5 at an elevated height relative to the user. The first telescoping leg 1 and the second telescoping leg 2 are terminally and adjacently positioned with each other. Additionally, the first telescoping leg 1 and the second telescoping leg 2 are hingedly mounted to each other. This hinged connection enables the present invention to be positioned into a collapsed configuration or a functional configuration. The collapsed configuration is used for storage and transportation. The functional configuration is used to visually indicate the user's presence. This is achieved through the light-emitting device 5. The light-emitting device 5 is an electric device that converts electrical energy into visible light. The light-emitting device 5 visually alerts vehicle operators to user's presence thereby decreasing the chances of a collision and/or accident. The light-emitting device 5 is terminally positioned to the first telescoping leg 1, opposite the second telescoping leg 2. Additionally, the light-emitting device 5 is adjacently mounted to the first telescoping leg 1 to be raised or lowered relative to the user. Type of devices that may be used as the light-emitting device 5 include, but are not limited to, light-emitting diodes, incandescent bulbs, fluorescent bulbs, halogen bulbs, neon bulbs, and other similar devices.

The light-emitting device 5 is electrically powered by the power source 6. The power source 6 is any electrical device capable of storing electrical energy. The power source 6 is mounted to the first telescoping leg 1 and is electrically connected to the light-emitting device 5. Type of devices that may be used as the power source 6 include, but are not limited to, rechargeable batteries, disposable batteries, and other similar devices. It is preferred that the power source 6 is internally mounted within the first telescoping leg 1 for protection from physical damage and for weatherproof purposes. The power button 10 controls the flow of electricity from the power source 6 to the light-emitting device 5, thus turning on and off the present invention. Specifically, the power button 10 is electrically connected in between the power source 6 and the light-emitting device 5. In regard to positioning, the power button 10 is positioned adjacent to the light-emitting device 5 and is laterally integrated into the first telescoping leg 1 for easier access to the user.

Figure 2:
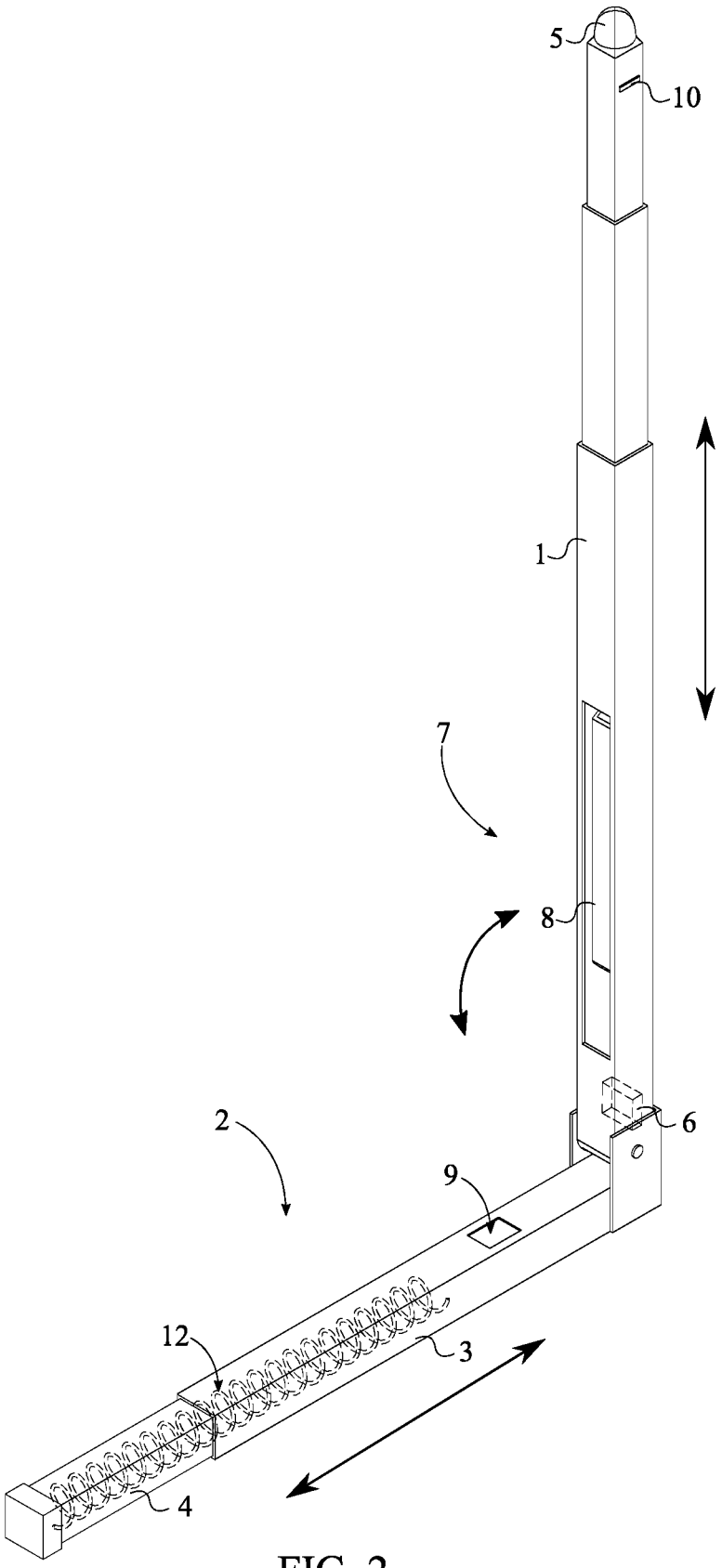
FIG. 2 is a partial internal perspective view of the present invention in a functional configuration.
Figure 3:
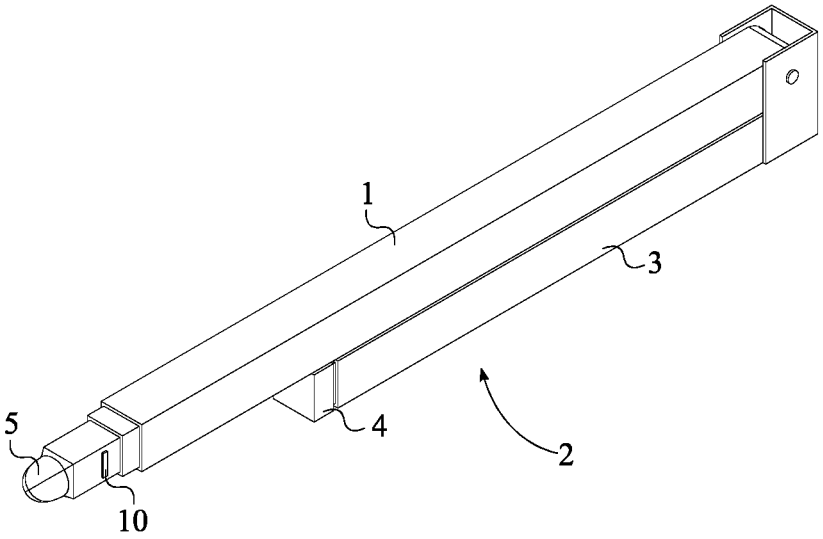
FIG. 3 is a perspective view of the present invention in a collapsed configuration.

Referring to FIG. 2 and FIG. 3, the present invention further comprises a locking mechanism 7. The locking mechanism 7 provides a means of locking the present invention in the functional configuration. For this, the locking mechanism 7 is mechanically integrated in between the first telescoping leg 1 and the second telescoping leg 2. In the collapsed configuration the first telescoping leg 1 and the second telescoping leg 2 are positioned parallel and adjacent to each other. Resultantly, the overall profile of the present invention is significantly reduced, allowing the user to easily transport and store the present invention. In the functional configuration, the first telescoping leg 1 and the second telescoping leg 2 are positioned perpendicular to each other. The locking mechanism 7 ensures that the present invention stays in the functional configuration while being used as a visual aid by securing the first telescoping leg 1 and the second telescoping leg 2 in the perpendicular orientation relative to each other.

In the preferred embodiment, the present invention is mounted/attached to the user through the use of a backpack. The present invention is designed to be positioned within a backpack with the first telescoping leg 1, the power button 10, and the light-emitting device 5 extending out of the backpack to increase the user's visibility to vehicle operators. For this placement, the second telescoping leg 2 is horizontally positioned within the backpack, ideally at the bottom of the backpack and parallel to a base of the backpack. The second telescoping leg 2 acts as a support base for the present invention. To ensure that the present invention is secure within the backpack, the length of the second telescoping leg 2 is adjusted to the width of the backpack. The first telescoping leg 1 is positioned parallel along the height of the backpack and extends out of the backpack; additionally, the zipper of the backpack is preferably positioned closed about the first telescoping leg 1 for further support. This ensures that the first telescoping leg 1 is secured in a vertical orientation with the light-emitting device 5 being positioned outside and vertically offset to the backpack. Additionally, the user may adjust the length of the first telescoping leg 1 to raise or lower the light-emitting device 5 relative to the backpack and therefore the user.

Referring to FIG. 2, to further secure the present invention within the backpack, the present invention further comprises a tensioning mechanism 12. The tensioning mechanism 12 is a device that creates a constant force to create or maintain a specific configuration. In the present invention, the tensioning mechanism 12 maintains the length of the second telescoping leg 2 and thus secures the second telescoping leg 2 within the backpack. It is preferred that the second telescoping leg 2 comprises a primary tubular segment 3 and an at least one secondary tubular segment 4. The secondary tubular segment 4 is sized to complimentary fit within the primary tubular segment 3 to allow for relative movement. The primary tubular segment 3 is positioned adjacent to he first telescoping leg 1 and the secondary tubular segment 4 is positioned opposite the first telescoping leg 1, along the primary tubular segment 3. Specifically, the secondary tubular segment 4 is slidably engaged within and along the primary tubular segment 3. Sliding the secondary tubular segment 4 increases and decreases the overall length of the secondary telescoping leg to match different sized backpacks. The tensioning mechanism 12 applies a force in between the primary tubular segment 3 and the secondary tubular segment 4 such that the primary tubular segment 3 and the secondary tubular segment 4 are pushed away from each other. Specifically, the tensioning mechanism 12 is mechanically integrated in between the primary tubular segment 3 and the secondary tubular segment 4. Resultantly, when the second telescoping leg 2 is positioned within the backpack, the primary tubular segment 3 and the secondary tubular segment 4 are pushed away from each other and apply pressure on the insides of the backpack, thus securing the present invention to the backpack. Type of tensioning mechanism 12 include springs, crank and pulley systems, and other similar mechanisms.

In the preferred embodiment of the present invention, the secondary telescoping leg further comprises a first telescoping locking mechanism 7. The first telescoping locking mechanism 7 is mechanically integrated in between the primary tubular segment 3 and the secondary tubular segment 4. The first telescoping locking mechanism 7 secures the primary tubular segment 3 and the secondary tubular segment 4 to each other, preferably at a relatively short length for storage and transportation purposes. Type of mechanisms that may be used as the first telescoping locking mechanism 7 include, but are not limited to, slot-and-pin locking mechanism 7, latches, and other similar mechanisms.

Referring to FIG. 1, in the functional configuration, the present invention is positioned into an L-shaped configuration. Specifically, the first telescoping leg 1 and the second telescoping leg 2 are positioned perpendicular to each other. The functional configuration is locked into place by the locking mechanism 7. The locking mechanism 7 preferably comprises a support bar 8 and a bar-receiving notch 9, although alternative mechanisms and components may also be utilized. The support bar 8 is an elongated bracket designed to fit in between the first telescoping leg 1 and the second telescoping leg 2 at an angle, yielding an overall triangular shape. Specifically, the support bar 8 is terminally and hingedly mounted to the first telescoping leg 1 with a free end of the support bar 8 being oriented towards the second telescoping leg 2. The bar-receiving notch 9 is positioned along the second telescoping leg 2 and is shaped complimentary to the support bar 8. Additionally, the bar-receiving notch 9 normally traverses into the second telescoping leg 2. When the present invention is positioned into the functional configuration, the support bar 8 is terminally positioned within the bar-receiving notch 9 to physically lock the first telescoping leg 1 and the second telescoping leg 2 in a perpendicular orientation relative to each other.

In one embodiment of the present invention, the support bar 8 is terminally positioned within the first telescoping leg 1 through a bar-receiving cavity; wherein the bar-receiving cavity normally traverses into the first telescoping leg 1 and has a length equal to or greater than a length of the support bar 8. This configuration provides a storage place for the support bar 8 when the present invention is in the collapsed configuration. Specifically, in the collapsed configuration, the support bar 8 is rotated such that the support bar 8 is positioned within and parallel to the first telescoping leg 1. Additionally, the support bar 8 is preferably sized to fit within the individual segments of the first telescoping leg 1 such that the support bar 8 does not interfere or limit the collapsed length of the first telescoping leg 1. When the first telescoping leg 1 is collapsed to a shorter length, the support bar 8 slides within all the segments of the first telescoping leg 1. In another embodiment of the present invention, the support bar 8 is terminally and hingedly attached to the first telescoping leg 1 laterally and includes a flange that fits within the bar-receiving cavity. In further alternative embodiments of the present invention, the locking mechanism 7 may be implemented as pin-in-slot mechanisms, hinge locking mechanism 7, and other similar mechanisms designed to lock a hinge.

Figure 4:
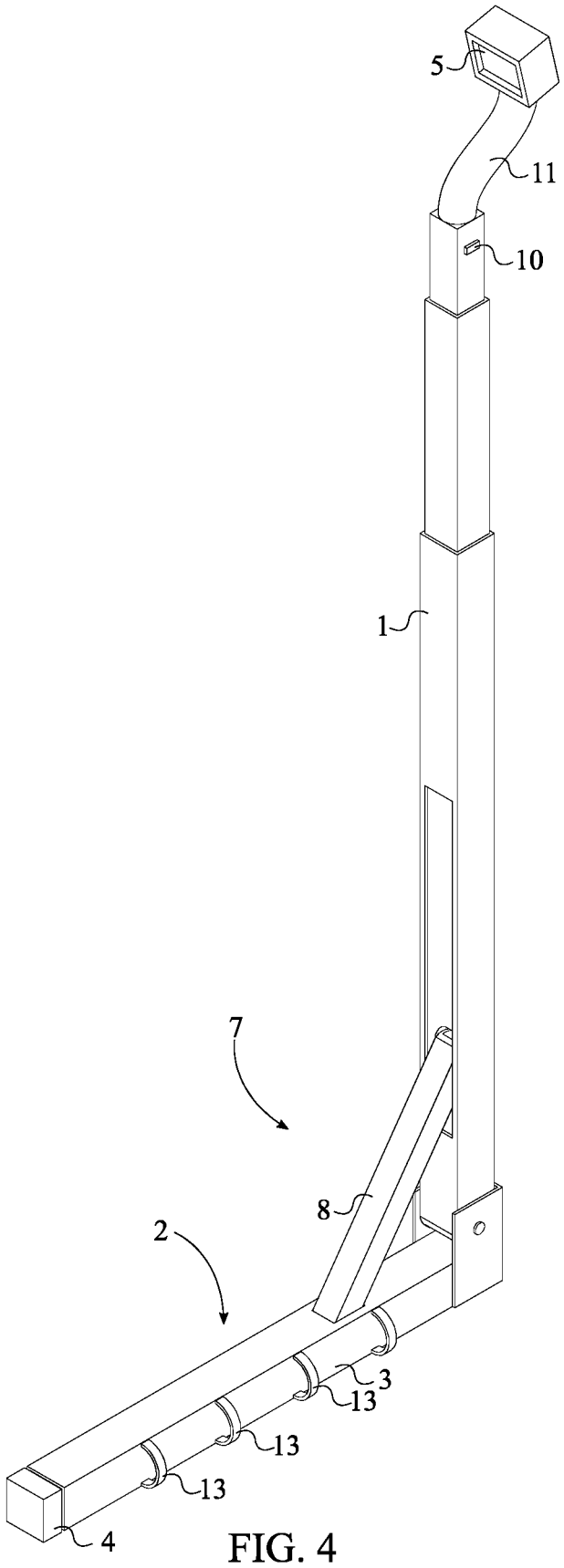
FIG. 4 is a perspective view of an alternative embodiment of the present invention.

In another embodiment of the present invention, the light-emitting device 5 is a flood light as seen in FIG. 4. The flood light provides the user with a strong enough light source to be used to light up a path in a dark area and/or at night for safety purposes. Additionally, the present invention further comprises a gooseneck support bar 11 that allows the user to reposition and orient the flood light according to his or her specific needs. The gooseneck support bar 11 is an elongated flexible rod that is capable of twisting, turning, and rotating. The gooseneck support bar 11 is terminally connected to the first telescoping leg 1, opposite the second telescoping leg 2. The flood light is terminally connected to the gooseneck support bar 11, opposite the first telescoping leg 1. Resultantly, adjusting the configuration of the gooseneck support bar 11 will orient and position the flood light as well. This allows the user to position the light being emitted from the flood light to meet individual preferences and needs. This is especially useful while walking, running, riding a bicycle or using other means of transportation as the flood light may be used to illuminate a safe path for the user and reveal possible obstacles to the user that otherwise might be hidden in the dark. The present invention is preferably waterproof and durable such that the present invention may be used in a variety of situations, weather conditions, and environments.

In another embodiment, the present invention may be implemented to attach to other structures besides a backpack. Specifically, the present invention may be implemented to attach/mount to a belt, a piece of clothing, the chest of the user, an animal harness, a wheelchair, and other similar living or inanimate objects. For this, the present invention further comprises a fastening mechanism 13. The fastening mechanism 13 is positioned adjacent to and along the second telescoping leg 2. Additionally, the fastening mechanism 13 is mounted to the second telescoping leg 2. A variety of mechanisms may be used as the fastening mechanism 13. Specifically, the fastening mechanism 13 is selected from the group consisting of a hook-and-loop fastener, a zipper fastener, and a plurality of belt loops.

In one embodiment of the present invention, the hook-and-loop fastener is utilized to attach the present invention to an external structure, wherein the hook-and-loop fastener comprises an at least one hook strip and an at least one loop strip. The loop strip is adjacently connected to the second telescoping leg 2, along the second telescoping leg 2. The hook strip is attached to an external structure such as a harness or a wheelchair. To attach the present invention to the external structure, the hook strip is mechanically engaged with the loop strip.

In one embodiment of the present invention, the zipper fastener is used to attach the present invention to an external structure, wherein the zipper fastener comprises a first interlocking strip and a second interlocking strip. For this, the first interlocking strip is adjacently attached along the second telescoping leg 2 while the second interlocking strip is adjacently attached to an external structure. To attach the present invention to the external structure, the first interlocking strip is mechanically engaged to the second interlocking strip.

In one embodiment of the present invention, the plurality of belt loops is utilized to attach the present invention to an external structure. For this, the plurality of belt loops is distributed along the second telescoping leg 2 with each of the plurality of belt loops being adjacently connected to the second telescoping leg 2. To attach the present invention to the external structure, the user runs a belt through each of the plurality of belt loops and secures the belt about his or her waist or the external structure. This provides a means of attaching/mounting the present invention without the need of a backpack.

Although the invention has been explained in relation to its preferred embodiment, it is to be understood that many other possible modifications and variations can be made without departing from the spirit and scope of the invention as hereinafter claimed.

What is claimed is:

1. A collision risk mitigation pedestrian light emitter comprising:

a first telescoping leg;

a second telescoping leg;

a light-emitting device;

a power source;

a locking mechanism;

the first telescoping leg and the second telescoping leg being terminally and adjacently positioned with each other;

the first telescoping leg and the second telescoping leg being hingedly mounted to each other;

the light-emitting device being terminally positioned to the first telescoping leg, opposite the second telescoping leg;

the light-emitting device being adjacently mounted to the first telescoping leg;

the locking mechanism being mechanically integrated in between the first telescoping leg and the second telescoping leg;

the power source being mounted to the first telescoping leg; and the power source being electrically connected to the light-emitting device.

2. The collision risk mitigation pedestrian light emitter as claimed in claim 1 comprising:

wherein the first telescoping leg and the second telescoping leg being configured into a functional configuration;

the locking mechanism comprising a support bar and a bar-receiving notch;

the first telescoping leg and the second telescoping leg being positioned perpendicular to each other;

the support bar being terminally and hingedly mounted to the first telescoping leg;

the bar-receiving notch being positioned along the second telescoping leg;

the bar-receiving notch normally traversing into the second telescoping leg; and the support bar being terminally positioned within the bar-receiving notch.

3. The collision risk mitigation pedestrian light emitter as claimed in claim 1 comprising:

wherein the first telescoping leg and the second telescoping leg being configured into a collapsed configuration; and the first telescoping leg and the second telescoping leg being positioned adjacent and parallel to each other.

4. The collision risk mitigation pedestrian light emitter as claimed in claim 1 comprising:

a power button;

the power button being positioned adjacent to the light-emitting device;

the power button being laterally integrated into the first telescoping leg; and the power button being electrically connected in between the power source and the light-emitting device.

5. The collision risk mitigation pedestrian light emitter as claimed in claim 1 comprising:

the light-emitting device being a flood light;

a gooseneck support bar;

the gooseneck support bar being terminally connected to the first telescoping leg, opposite the second telescoping leg; and the flood light being terminally connected to the gooseneck support bar, opposite the first telescoping leg.

6. The collision risk mitigation pedestrian light emitter as claimed in claim 1 comprising:

a tensioning mechanism;

the second telescoping leg comprising a primary tubular segment and an at least one secondary tubular segment;

the primary tubular segment being positioned adjacent to the first telescoping leg;

the secondary tubular segment being positioned opposite the first telescoping leg, along the primary tubular segment;

the secondary tubular segment being slidably engaged within and along the primary tubular segment; and the tensioning mechanism being mechanically integrated in between the primary tubular segment and the secondary tubular segment.

7. The collision risk mitigation pedestrian light emitter as claimed in claim 1 comprising:

a fastening mechanism;

the fastening mechanism being positioned adjacent and along the second telescoping leg; and the fastening mechanism being mounted to the second telescoping leg.

8. The collision risk mitigation pedestrian light emitter and adaptor as claimed in claim 7, wherein the fastening mechanism is selected from the group consisting of a hook-and-loop fastener, a zipper fastener, and a plurality of belt loops.

9. A collision risk mitigation pedestrian light emitter comprising:

a first telescoping leg;

a second telescoping leg;

a light-emitting device;

a power source;

a locking mechanism;

a fastening mechanism;

the first telescoping leg and the second telescoping leg being terminally and adjacently positioned with each other;

the first telescoping leg and the second telescoping leg being hingedly mounted to each other;

the light-emitting device being terminally positioned to the first telescoping leg, opposite the second telescoping leg;

the light-emitting device being adjacently mounted to the first telescoping leg;

the locking mechanism being mechanically integrated in between the first telescoping leg and the second telescoping leg;

the power source being mounted to the first telescoping leg;

the power source being electrically connected to the light-emitting device;

the fastening mechanism being positioned adjacent and along the second telescoping leg; and the fastening mechanism being mounted to the second telescoping leg.

10. The collision risk mitigation pedestrian light emitter as claimed in claim 9 comprising:

wherein the first telescoping leg and the second telescoping leg being configured into a functional configuration;

the locking mechanism comprising a support bar and a bar-receiving notch;

the first telescoping leg and the second telescoping leg being positioned perpendicular to each other;

the support bar being terminally and hingedly mounted to the first telescoping leg;

the bar-receiving notch being positioned along the second telescoping leg;

the bar-receiving notch normally traversing into the second telescoping leg; and the support bar being terminally positioned within the bar-receiving notch.

11. The collision risk mitigation pedestrian light emitter as claimed in claim 9 comprising:

wherein the first telescoping leg and the second telescoping leg being configured into a collapsed configuration; and the first telescoping leg and the second telescoping leg being positioned adjacent and parallel to each other.

12. The collision risk mitigation pedestrian light emitter as claimed in claim 9 comprising:

a power button;

the power button being positioned adjacent to the light-emitting device;

the power button being laterally integrated into the first telescoping leg; and the power button being electrically connected in between the power source and the light-emitting device.

13. The collision risk mitigation pedestrian light emitter as claimed in claim 9 comprising:

the light-emitting device being a flood light;

a gooseneck support bar;

the gooseneck support bar being terminally connected to the first telescoping leg, opposite the second telescoping leg; and the flood light being terminally connected to the gooseneck support bar, opposite the first telescoping leg.

14. The collision risk mitigation pedestrian light emitter as claimed in claim 9 comprising:

a tensioning mechanism;

the second telescoping leg comprising a primary tubular segment and an at least one secondary tubular segment;

the primary tubular segment being positioned adjacent to the first telescoping leg;

the secondary tubular segment being positioned opposite the first telescoping leg, along the primary tubular segment;

the secondary tubular segment being slidably engaged within and along the primary tubular segment; and the tensioning mechanism being mechanically integrated in between the primary tubular segment and the secondary tubular segment.

15. The collision risk mitigation pedestrian light emitter as claimed in claim 9, wherein the fastening mechanism is selected from the group consisting of a hook-and-loop fastener, a zipper fastener, and a plurality of belt loops.

* * * * *